US006029838A

United States Patent [19]

Hansen et al.

[11] Patent Number: 6,029,838

[45] Date of Patent: Feb. 29, 2000

[54] CHIP BIN

[75] Inventors: Christen Grønvold Hansen, Karlstad; Peter Christen Kylin, Hammarö; Sven-Erik Olsson, Sunne, all of Sweden

[73] Assignee: Kvaerner Pulping AB, Sweden

[21] Appl. No.: 09/214,793

[22] PCT Filed: Jun. 26, 1997

[86] PCT No.: PCT/SE97/01146

§ 371 Date: Jan. 7, 1999

§ 102(e) Date: Jan. 7, 1999

[87] PCT Pub. No.: WO98/01371

PCT Pub. Date: Jan. 15, 1998

[30] Foreign Application Priority Data

Jul. 9, 1996 [SE] Sweden ..... 9602709

[51] Int. Cl.[7] ..... B65D 25/14

[52] U.S. Cl. ..... 220/4.03; 220/4.01; 220/660; 220/DIG. 13

[58] Field of Search ..... 220/4.01, 4.03, 220/660, 669, DIG. 13

[56] References Cited

U.S. PATENT DOCUMENTS

| | | | |
|---|---|---|---|
| 1,331,372 | 2/1920 | Popper | 220/DIG. 13 |
| 3,565,280 | 2/1971 | Rausing | 220/4.01 |
| 4,057,163 | 11/1977 | Widart et al. | 220/4.01 |
| 4,452,381 | 6/1984 | Freeman | 220/DIG. 13 |
| 4,958,741 | 9/1990 | Johanson | 220/4.01 |

FOREIGN PATENT DOCUMENTS

2029046 B2 3/1980 Germany .

OTHER PUBLICATIONS

Derwent's abstract, No. 84–16278/03, week 8403, Abstract of SU, 1004212 (Forstman V A), Mar. 25, 1983.

Derwent's abstract, No. 91–49719/07, week 9107, Abstract of SU, 1570968 (Zurabishvili G G), Jun. 15, 1990.

*Primary Examiner*—Joseph M. Moy
*Attorney, Agent, or Firm*—Fasth Law Offices; Rolf Fasth

[57] ABSTRACT

A chip bin that has a feeding device, an upper container part and a discharge opening defined therein. A discharge zone is disposed between the upper container part and the discharge opening. The discharge zone has no moving parts and has a diameter that is decreasing from the upper container part down towards the discharge zone. The discharge zone has a discharge section in the form of a truncated cone that has a downwardly continuously decreasing circular cross section. The discharge section has a center line extending therethrough so that the center line and the longitudinal vertical axis of the chip bin form an acute angle alpha.

23 Claims, 4 Drawing Sheets

CHIP BIN

The present invention relates to a chip bin which is used within the pulp industry and is used for storing and possibly steaming chips for producing pulp.

The most common design of chip bins includes some form of tubular outlet device in order to ensure continuous discharge, such as for example the frequently used so-called "Vibra Bin". A disadvantage of such chip bins is that they are relatively expensive to maintain, among other things because of wear and the necessary maintenance associated therewith.

A chip bin which works entirely without moving parts is previously known through U.S. Pat. No. 4,958,741. If the climate allows, such a chip bin can function satisfactorily. The principle is based on the cross-section of the chip bin being reduced in stages down towards the discharge opening in a manner which eliminates the risk of bridge formation and consequently, with certain climatic prerequisites, continuous discharge can be ensured with such a construction.

The known device is based on the alternating use of oval and circular cross-sections. Such a construction leads to a disadvantage in that the oval cross-section is not optimal as far as strength is concerned. Furthermore, it is relatively complicated to construct and is therefore expensive. The aim of the present invention is to produce a chip bin which is based on a principle of functioning without moving parts but at the same time eliminates the abovementioned disadvantages of the known embodiment.

The solution is based on a chip bin comprising a feeding device, an upper container part, a discharge opening and, arranged between the container part and the discharge opening, a discharge zone, without moving parts, the discharge zone having a circular shape in any freely chosen horizontal cross-section, and on the fact that the cross-section of the discharge zone decreases from the container part (4) down towards the discharge opening (7), at least one section (3) of said discharge zone essentially having the shape of a truncated cone with a downwardly continuously decreasing circular cross-section, the centre point of which is continuously moved in relation to a vertical line, which is fixed with regard to the chip bin, in such a manner that said section (3) has a centre line which forms an acute angle ($\alpha$) in relation to the vertical line.

DETAILED DESCRIPTION

Figure 1:
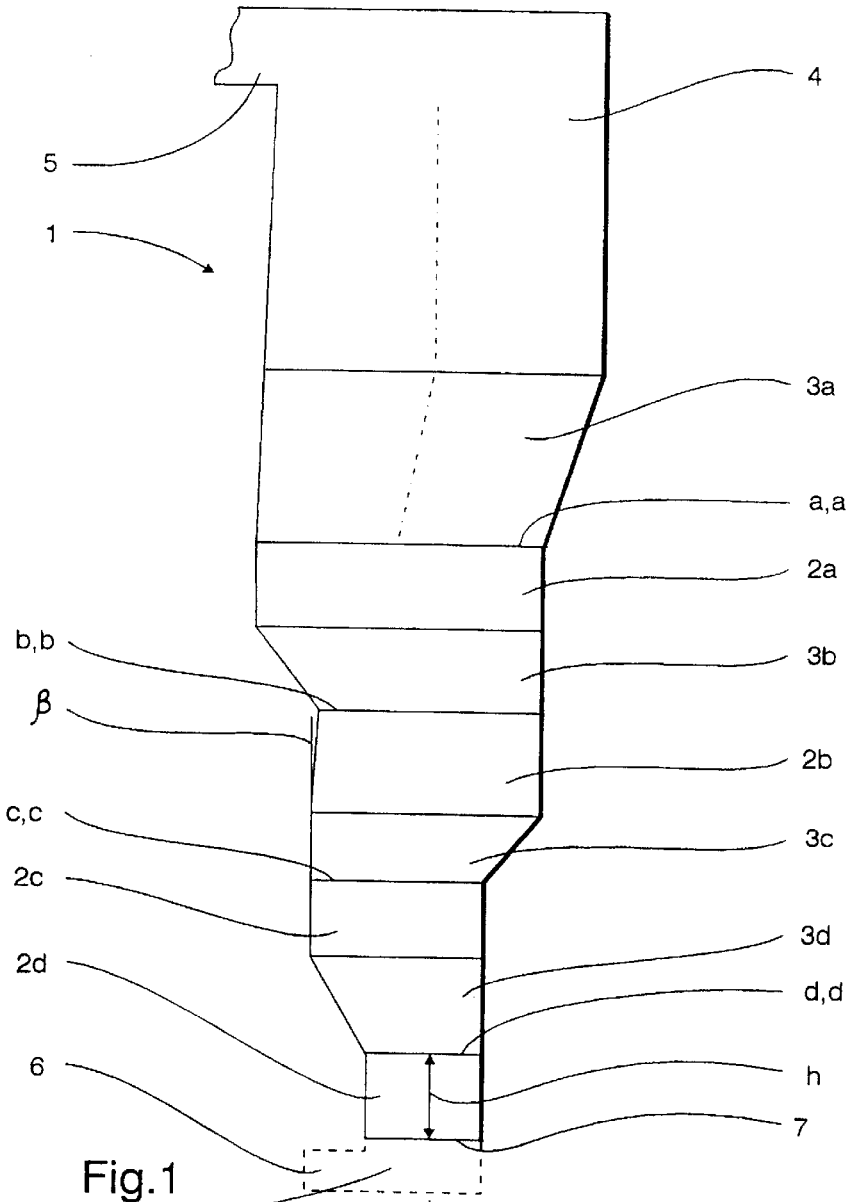
FIG. 1 shows a diagrammatic side view of a chip bin according to the invention.
Figure 2:
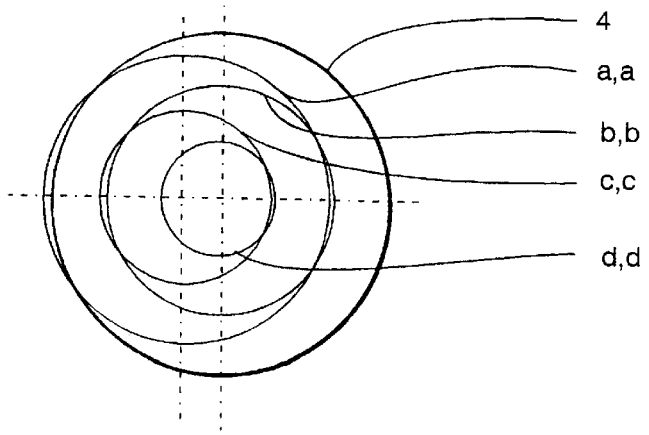
FIG. 2 shows the same embodiment in a view from above.

A first embodiment of the invention will be described in greater detail below. FIG. 1 shows a side view of a chip bin (1) with a discharge zone (2, 3, 7) according to the invention. The discharge zone comprises a number of circular units (2*a*, 2*b*, 2*c*, 2*d*). The largest circular unit (2*a*) is located uppermost in the discharge part of the chip bin and the smallest circular unit (2*d*) is located at the bottom and thus itself also forms the discharge opening (7) from the chip bin (1). Between the larger and the smaller circular units, two further circular units (2*b*) and (2*c*) are located, the diameter of which decreases gradually in relation to the largest, upper unit (2*a*). Each circular unit is positioned in a non-centred manner in relation to the circular unit immediately above or below, see FIG. 2. Between each circular unit (2), there is a connecting element which essentially has the shape of a truncated cone (3), the horizontal cross-section of which is circular in any chosen section. Above the discharge part (2, 3) described above, a container part (4) is situated, the design of which may vary but which expediently has a circular cross-section and is upwardly slightly conical so that a certain clearance is obtained along the inner periphery. At the top of the bin (1), a feeding device (5) (not described further) is arranged, which normally consists of a pipe which is fed via a belt or screw conveyor (not shown). In the preferred case, the outlet opening (7) is connected to a steaming vessel (6) which is shown only diagrammatically in the figure. In most cases, as indicated diagrammatically in FIG. 1, a chip meter (6') known per se is arranged between the steaming vessel (6) and the outlet opening.

The bin functions in such a manner that chips are fed in at the top and flow into the bin at the top through the feeding device (5). The feed flow is controlled in relation to the discharge flow and the quantity of chips present in the bin in such a manner that the desired chip level is obtained in the bin (1). Discharge of chips from the bin takes place entirely according to the principle of unassisted falling. The chips can fall out of their own accord without bridge formation because the outlet opening (2*d*) has a height (h) which is sufficiently small, in relation to the diameter (d), to eliminate the occurrence of bridge formation, preferably smaller than 1.5 d and most preferably smaller than d. When discharge of chips is then made possible (for example by the feed screw in a steaming vessel (6) exposing the outlet opening (7)), the quantity of chips present in the bottom cylindrical part (2*d*) falls out first. By virtue of the fact that the conical element (3*d*) above has one side essentially on a vertical line, bridge formation is also eliminated in this part and the quantity of chips discharged from the bottom part (2*d*) can be refilled from this section. In this manner, a continuous alternating transfer/refilling downwards through the chip bin is repeated continuously through the entire discharge section.

Figure 3:
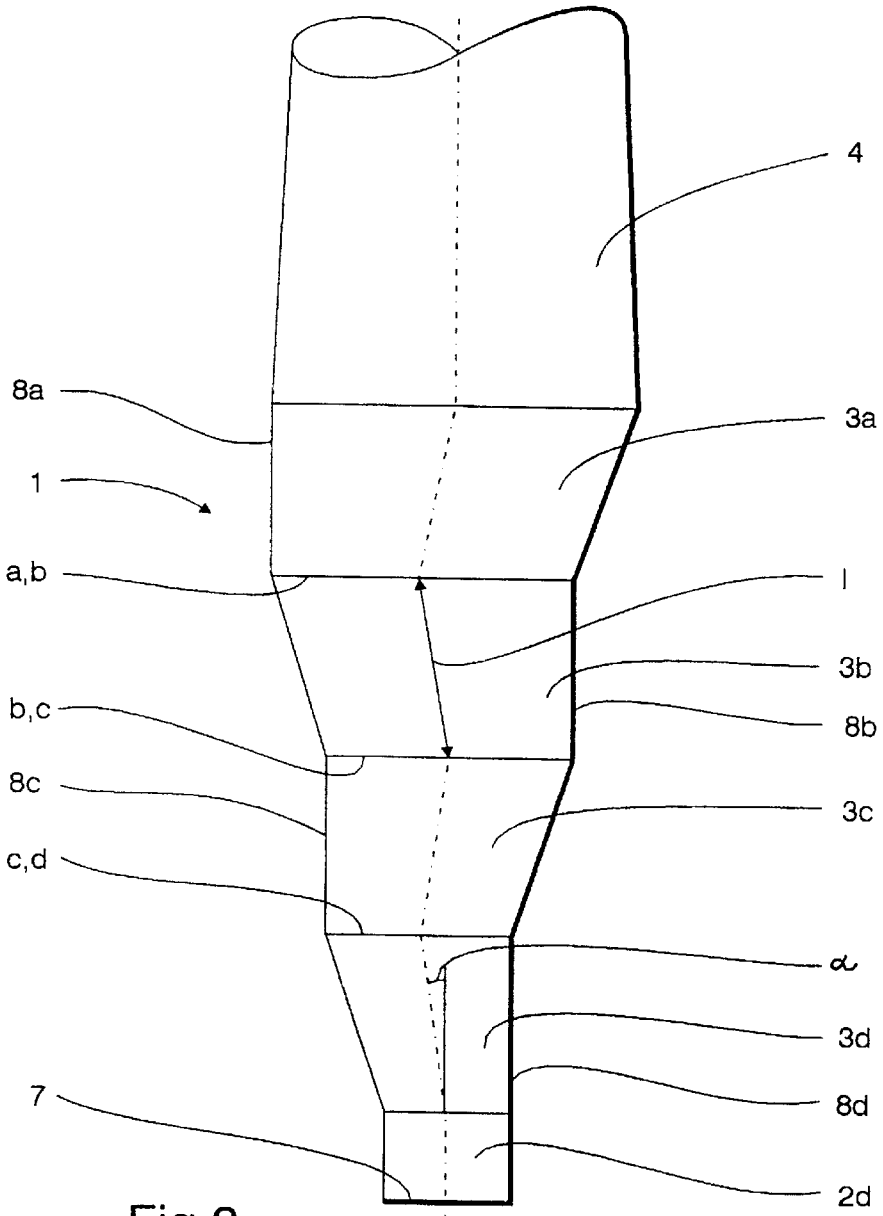
FIG. 3 shows a preferred embodiment of a chip bin in a side view and FIG. 4 shows the same preferred embodiment in a view from above.
Figure 4:
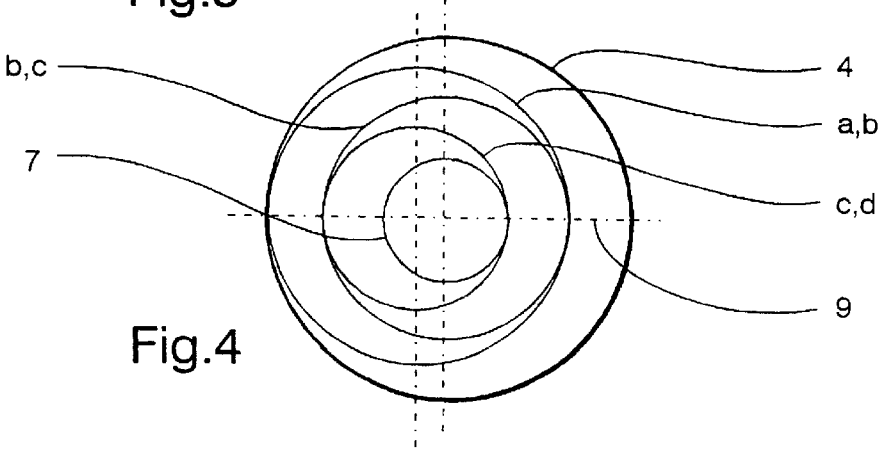

FIGS. 3 and 4 show a preferred embodiment of a chip bin according to the invention. Between the upper essentially cylindrical container unit (4) and the lower cylindrical discharge part (2*d*), 4 sections (3*a*, 3*b*, 3*c*, 3*d*) are arranged, which essentially have the shape of a truncated cone. Each such section has in any freely chosen horizontal cross-section a circular shape which continuously decreases in the downward direction towards the outlet opening (7). Each conical section (3) is positioned in such a manner that it has a downwardly continuously decreasing circular cross-section, the centre point of which is continuously moved in relation to a vertical line, which is fixed with regard to the chip bin, so that its centre line which forms an acute angle ($\alpha$) with the vertical line. Furthermore, each such section (3)

is positioned in such a manner that one (8) of its wall parts is located on the vertical line. According to the preferred embodiment, the length (1) of the centre line of each section (3) is such that it is shorter than the maximum diameter of the section which means, for the next to uppermost section (3*b*), that 1 is smaller than the diameter at the joint ab between this section and the similar section (3*a*) situated above it. FIG. 4 shows, with the aid of a view from above, how the various sections (2*d*, 3*a*, 3*b*, 3*c*, 3*d*, 4) are positioned in relation to one another, the line of symmetry for each section lying in one and the same vertical plane (9). The principle of functioning for this preferred embodiment is the same as for that described above.

Figure 5:
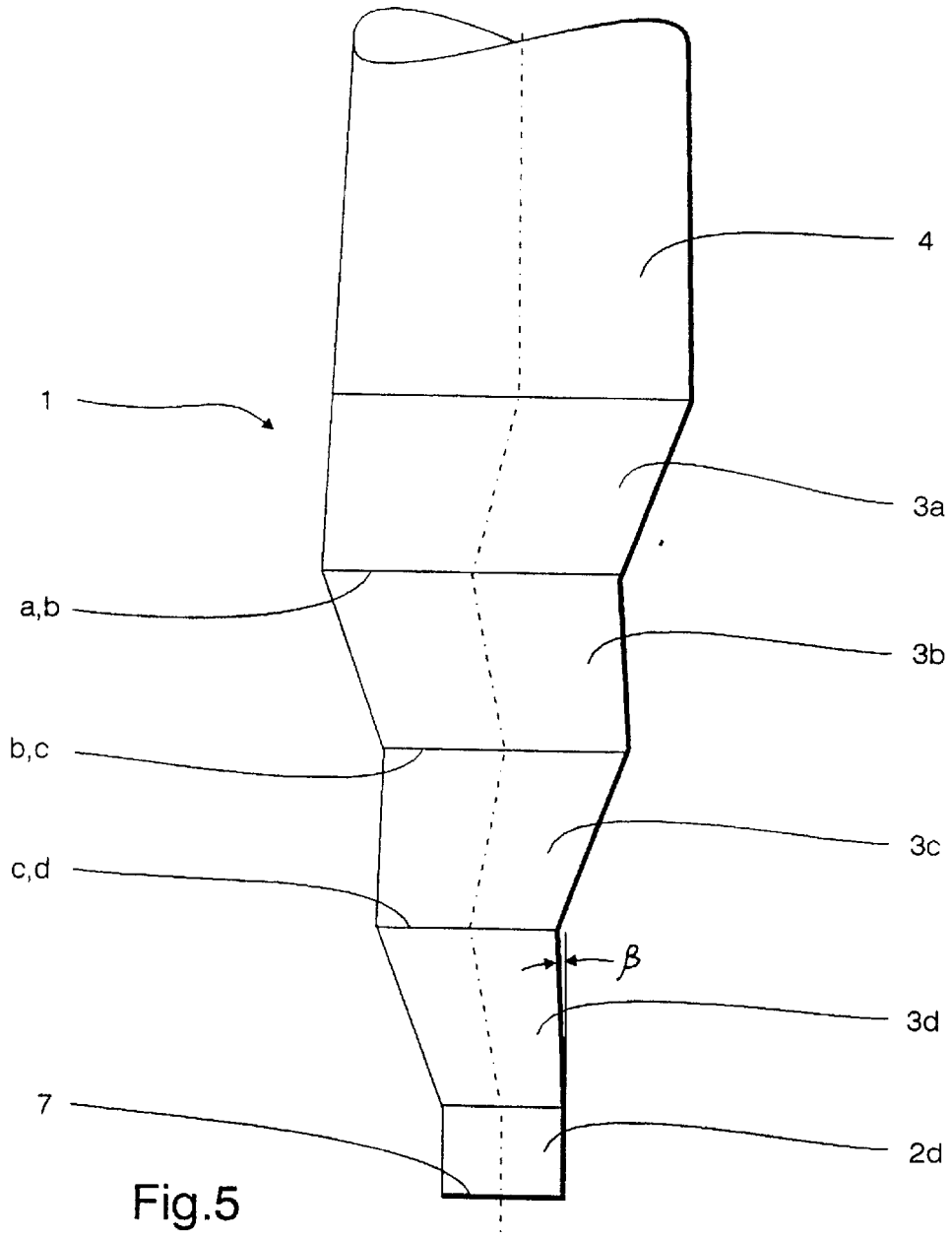
FIGS. 5 and 6 show a chip bin which is somewhat modified in relation to the preferred embodiment.
Figure 6:
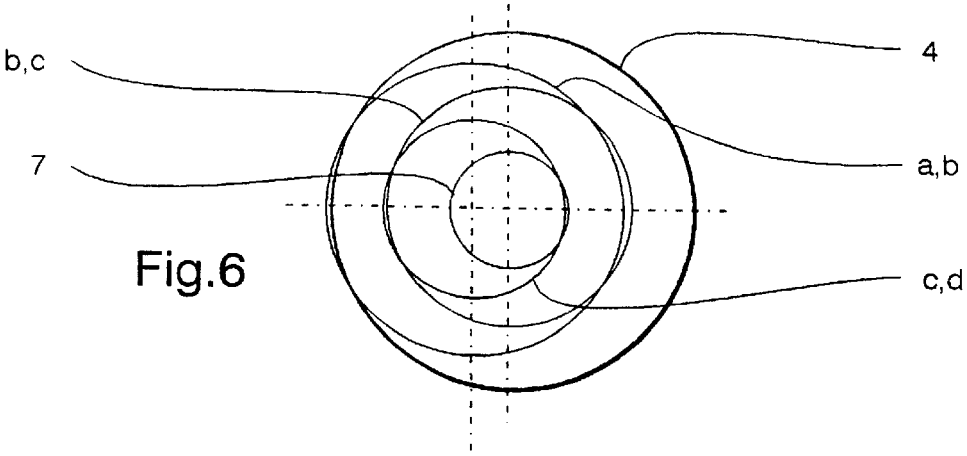

FIGS. 5 and 6 show in principle the same kind of discharge zone as in FIGS. 3 and 4. The one difference is that each wall part (8) which is located essentially on the vertical line is arranged so that a small clearance angle (β) is obtained.

Figure 7:
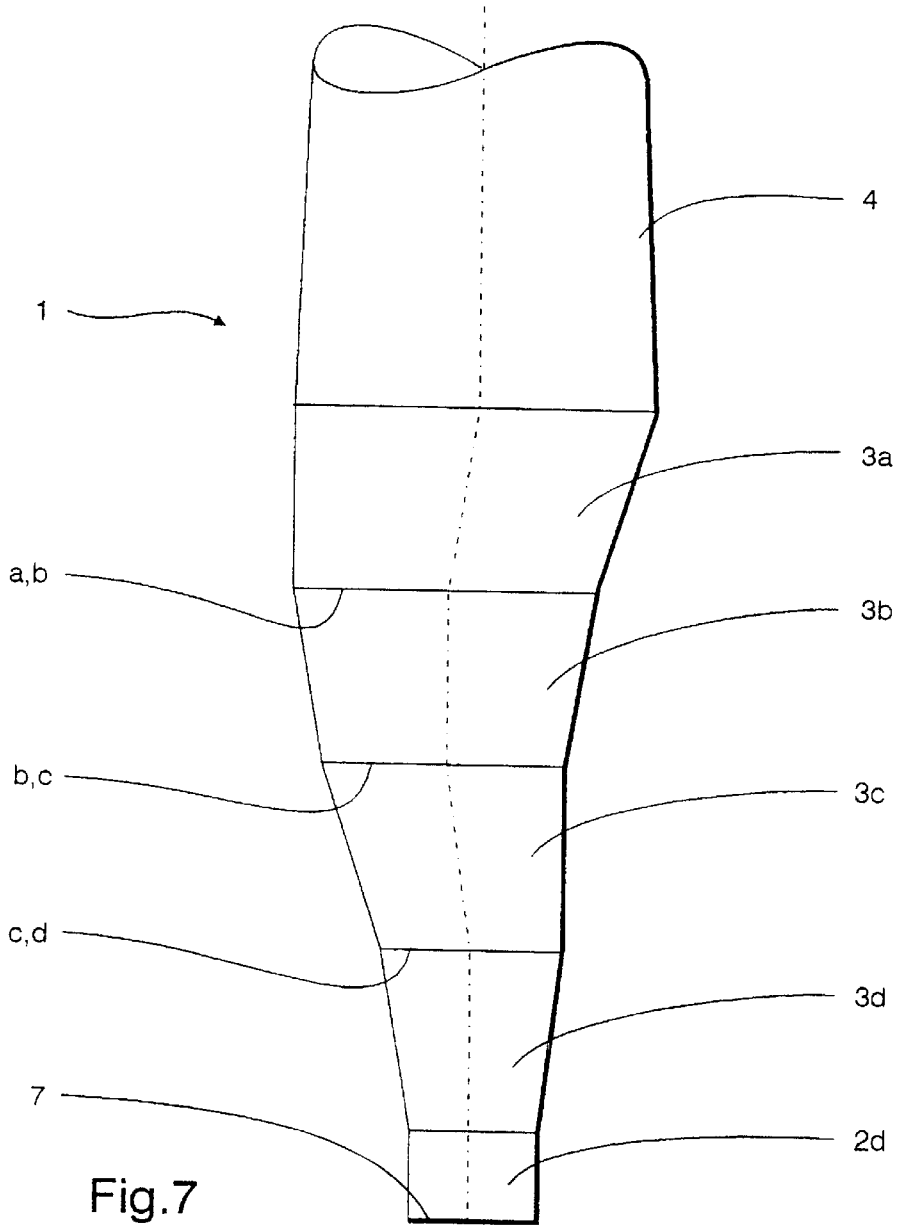
FIGS. 7 and 8 show an alternative positioning of the sections in the outlet arrangement of a chip bin according to the invention.
Figure 8:
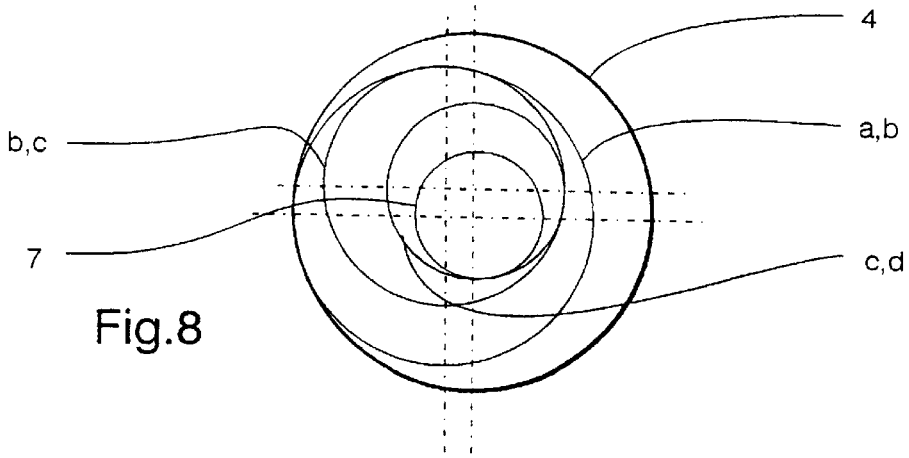

FIGS. 7 and 8 show an alternative positioning of the sections in relation to one another, the wall part (8) which coincides with the vertical line being displaced by 90° with regard to the section lying above and below respectively. The horizontal cross-section in any chosen section is circular.

A major advantage of the abovementioned embodiment is that the bin is made up of circular cross-sections, because the chip bin is exposed to great pressure from within. It is generally known that a circular shape is optimal as far as strength is concerned in connection with pressurization from within, because among other things the material thickness can then be made smaller than in any other shape which deviates from purely circular. Moreover, thanks to the circular shape, reinforcement arrangements can be dispensed with entirely. Additionally, the circular shape results in computer processing becoming easier, which results in simpler, more rational construction work and sheet-metal preparation etc. It is therefore obvious that the preferred embodiment according to the invention has clear advantages in comparison with using oval cross-sections or other non-circular cross-sections such as for example hexagonal cross-sections.

It is obvious that the invention can be modified as far as the preferred embodiment shown above is concerned but still be covered by the following patent claims. It is for example possible to produce a bin with both fewer and more sections than have been shown and also with varying degrees of inclination on the conical parts. Moreover, it is possible to deviate slightly from the purely cylindrical cross-section and instead have an upwardly slightly converging so-called cylinder part, if extra clearance (β, see FIGS) is desired in this position, but preferably not exceeding a 5° angle in relation to the vertical line.

The choice of material can of course be adapted to specific requirements and made for example of composite material, but the most preferred material is sheet metal. It is furthermore understood that the invention can also be used for discharging material other than chips, for example pellets or granulate.

We claim:

1. A chip bin having a vertical longitudinal axis, comprising:

a feeding device;

an upper container part device having a diameter exceeding 2.5 meters and in operative engagement with the feeding device;

a discharge opening defined in the chip bin, the discharge opening having a diameter that is less than 2.5 meter;

a discharge zone disposed between the upper container part and the discharge opening, the discharge zone lacking moving parts, the discharge zone having a circular shape in a horizontal cross-section, the discharge zone having a diameter that decreases from the upper container part down towards the discharge opening; and the discharge zone having a substantially truncated cone having a downwardly decreasing circular cross-section, the truncated cone having a center line extending therethrough, the center line of the truncated cone and the vertical longitudinal axis of the chip bin forming an acute angle alpha.

2. The chip bin according to claim 1 wherein the diameter of the upper container part exceeds 3.5 meters.

3. The chip bin according to claim 1 wherein the diameter of the upper container part exceeds 4.5 meters.

4. The chip bin according to claim 1 wherein the discharge zone comprises two discharge sections.

5. The chip bin according to claim 1 wherein the discharge zone comprises three discharge sections.

6. The chip bin according to claim 1 wherein the discharge zone comprises four discharge sections.

7. The chip bin according to claim 1 wherein the discharge zone comprises a first substantially cylindrical unit that has a first size and a second substantially cylindrical unit that has a second size, the first size is different from the second size, the first and second cylindrical units are positioned in a non-centered manner relative to one another.

8. The chip bin according to claim 7 wherein the upper container part is position in a centered manner and the first and second cylindrical units are positioned in a non-centered manner.

9. The chip bin according to claim 1 wherein the discharge zone has a discharge section that is connected to a cylindrical unit, the discharge section comprises the truncated cone.

10. The chip bin according to claim 9 wherein the truncated cone has a side that is disposed on the vertical longitudinal axis of the chip bin.

11. The chip bin according to claim 1 wherein the diameter of the discharge opening is less than 2 meters.

12. The chip bin according to claim 1 wherein the diameter of the discharge opening is less than 1.5 meters.

13. The chip bin according to claim 1 wherein the diameter of the discharge opening is less than 1 meter.

14. The chip bin according to claim 1 wherein the truncated cone is upwardly conical, the truncated cone has a side wall that forms an angle with the vertical longitudinal axis that is less than 10 degrees.

15. The chip bin according to claim 1 wherein the truncated cone is upwardly conical, the truncated cone has a side wall that forms an angle with the vertical longitudinal axis that is less than 5 degrees.

16. The chip bin according to claim 1 wherein the truncated cone is upwardly conical, the truncated cone has a side wall that forms an angle with the vertical longitudinal axis that is less than 3 degrees.

17. The chip bin according to claim 9 wherein the cylindrical unit is entirely cylindrical.

18). The chip bin according to claim 9 wherein the cylindrical unit has a height (h) and a diameter (d) so that h<2d.

19. The chip bin according to claim 9 wherein the cylindrical unit has a height (h) and a diameter (d) so that h<1.5d.

20. The chip bin according to claim 9 wherein the cylindrical unit has a height (h) and a diameter (d) so that h<d.

21. The chip bin according to claim 1 wherein the truncated cone has a center line with the length (l) and the truncated cone has a maximum diameter (dmax) so that l<2dmax.

22. The chip bin according to claim 1 wherein the truncated cone has a center line with the length (l) and the truncated cone has a maximum diameter (dmax) so that l<1.5dmax.

23. The chip bin according to claim 1 wherein the truncated cone has a center line with the length (l) and the truncated cone has a maximum diameter (dmax) so that l<dmax.

* * * * *